US008960939B2

(12) United States Patent
Ho

(10) Patent No.: US 8,960,939 B2
(45) Date of Patent: Feb. 24, 2015

(54) LIQUID MOTION LAMP HOLDER COMBINED LIGHTING

(71) Applicant: Su-Fang Ho, New Taipei (TW)

(72) Inventor: Su-Fang Ho, New Taipei (TW)

( * ) Notice: Subject to any disclaimer, the term of this patent is extended or adjusted under 35 U.S.C. 154(b) by 180 days.

(21) Appl. No.: 13/803,700

(22) Filed: Mar. 14, 2013

(65) Prior Publication Data

US 2014/0268674 A1 Sep. 18, 2014

(51) Int. Cl.

| | |
|---|---|
| ***F21V 33/00*** | (2006.01) |
| ***F21V 19/00*** | (2006.01) |
| ***F21V 1/00*** | (2006.01) |
| ***F21V 31/04*** | (2006.01) |

(52) U.S. Cl.

CPC . *F21V 19/00* (2013.01); *F21V 1/00* (2013.01); *F21V 31/04* (2013.01)

USPC ..... 362/101; 362/431

(58) Field of Classification Search

USPC ..... 362/641, 642, 643, 644, 645, 646, 647, 362/648, 649, 650, 651, 652, 653, 249.01, 362/249.02, 249.03, 249.04, 285, 287, 362/217.01, 225, 217.1, 217.11, 217.12, 362/217.13, 217.14, 217.15, 217.16, 362/217.17, 410, 318, 190, 191, 198, 431, 362/457, 458, 171, 172, 175, 176, 178, 181, 362/565, 84, 101, 167, 368, 369, 370, 371, 362/372, 373, 374, 375, 800, 806, 808, 811, 362/801, 154

See application file for complete search history.

(56) References Cited

U.S. PATENT DOCUMENTS

| | | | | |
|---|---|---|---|---|
| 4,974,127 | A * | 11/1990 | Foley | 362/96 |
| 6,513,284 | B1 * | 2/2003 | Sandlin | 47/66.6 |
| 2002/0080604 | A1 * | 6/2002 | Niermann | 362/173 |
| 2003/0112621 | A1 * | 6/2003 | Lee | 362/96 |
| 2005/0207141 | A1 * | 9/2005 | Boesch et al. | 362/101 |
| 2008/0174988 | A1 * | 7/2008 | Lin et al. | 362/154 |
| 2008/0239705 | A1 * | 10/2008 | Lin et al. | 362/101 |
| 2009/0135585 | A1 * | 5/2009 | Yang | 362/101 |
| 2012/0106132 | A1 * | 5/2012 | Chien | 362/101 |

* cited by examiner

*Primary Examiner* — Anh Mai
*Assistant Examiner* — Fatima Farokhrooz
(74) *Attorney, Agent, or Firm* — Rosenberg, Klein & Lee

(57) ABSTRACT

The invention relates to a liquid motion lamp holder combined lighting, comprising: a holder having a base, a first mounted seat, a second mounted seat, a support bracket, and a transparent bottle having at least two immiscible substances therein and arranged between the first mounted seat and second mounted seat. Whereby the transparent bottle turns into liquid motion lamp visual effect through a projected light of an LED bulb at a bottom of the first containing room and required lighting is available through the lighting bulb. Due to the design of the containing height of the second containing room, an end of the transparent bottle can be moved in the containing height along the vertical axis of the base up and down for the transparent bottle to be easily installed and removed between the first mounted seat and second mounted seat.

7 Claims, 8 Drawing Sheets

LIQUID MOTION LAMP HOLDER COMBINED LIGHTING

BACKGROUND OF THE INVENTION

1. Field of the Invention

The invention relates to a liquid motion lamp holder combined lighting, particularly to a bulb projection liquid motion lamp combining with a lighting lamp seat and to a transparent bottle being easily installed and removed.

2. Description of the Related Art

Since the sixties of the last century, lava lamps have become a common device in the worldwide university student dormitories and teenage children bedrooms. Lava lamps have been deeply implanted into the popular culture of the United States and many other countries.

With reference to FIG. 1, U.S. Pat. No. 3,570,156 discloses a lava lamp display device 60 comprising: a glass vessel 61 having a bottom 62 arranged in a hollow conical metallic seating 63 and located on an electric light bulb 64. Moreover, the glass vessel 61 has two immiscible substances. For example, the first substance is liquid 65 and the second substance is paraffin 66 which has a higher density than the liquid 65 at room temperature and a lower density than the liquid 65 after heating. After the electric light bulb 64 is turned on, the paraffin 66 in the bottom 62 of the glass vessel 61 is heated and flows in the liquid 65. At the same time, the electric light bulb 64 projects the light in the glass vessel 61, forming a lighting effect and becoming decorations at home and office. The solid paraffin requires a long time for heating to melt while suspended in the liquid. Therefore, in recent practice, the second substance is set to be a solid or liquid, and the specific gravity value thereof must be similar to the liquid of the first substance such that the lava lamp has it a dynamic function via the short heating time. Such improvement and the aforesaid lava lamp structure are so called liquid motion lamp.

The principle of the liquid motion lamp is to provide a heat from a bulb for the liquid of first substance within the container to produce convection for the second floating substance in the liquid moving up and down with the liquid. Under the illumination of the projection light, the floating objects float and sink, producing brilliant and vivid visuals.

However, the transparent container without stable installation structure is easily overturned and broken, which allows the internal liquid to harm human body. Therefore, the present invention is provided for enhancing the stability and safety of the liquid motion holder and the convenience of the installing and removing the transparent bottle.

SUMMARY OF THE INVENTION

It is the first primary object of the present invention to provide a liquid motion lamp holder combined lighting to combine lighting and decoration functions.

It is the second object of the present invention to provide stable liquid motion lamp holder to avoid overturning and falling apart the transparent container which is able to harm human body by flowing-out liquid of the transparent container.

It is the last object of the present invention to provide a liquid motion lamp transparent bottle and a bulb which are easy to be installed and removed for increasing the convenience and security effects.

In order to achieve the above objects, the liquid motion lamp holder improvement comprises: a holder having a base on a bottom thereof; a first mounted seat having a bottom mounted on the base and a first containing room with an upward opening at an inner periphery thereof; a second mounted seat arranged on a top of the holder and having a second containing room with a downward opening at an inner periphery thereof and the second containing room having a containing height of at least 5 cm; a support bracket having an end connecting to a lower end of the holder and another end connecting to the second mounted seat for centers of the first mounted seat and second mounted seat to be vertically located on an axis of the base, being in an up-down corresponding state; a projecting light source including a first lamp seat mounted in the first containing room of the first mounted seat and a bulb mounted on the first lamp seat; a lighting lamp including a second lamp seat mounted on the support bracket and a lighting bulb mounted on the second lamp seat; and a transparent bottle arranged between the first mounted seat and second mounted seat and having two immiscible substances therein, an upper end for moving upward to the second containing room to a predetermined height and a lower end for moving downward to the first containing room so that the transparent bottle is securely positioned between the second containing room and first containing room.

Whereby the transparent bottle turns into liquid motion lamp visual effect through the projecting light source and required lighting is available through the lighting bulb, and the design of the second containing room allows an end of the transparent bottle to be moved in the containing height along the vertical axis of the base up and down for the transparent bottle to be easily installed and removed between the first mounted seat and second mounted seat.

DETAILED DESCRIPTION OF THE PREFERRED EMBODIMENT

Figure 1:
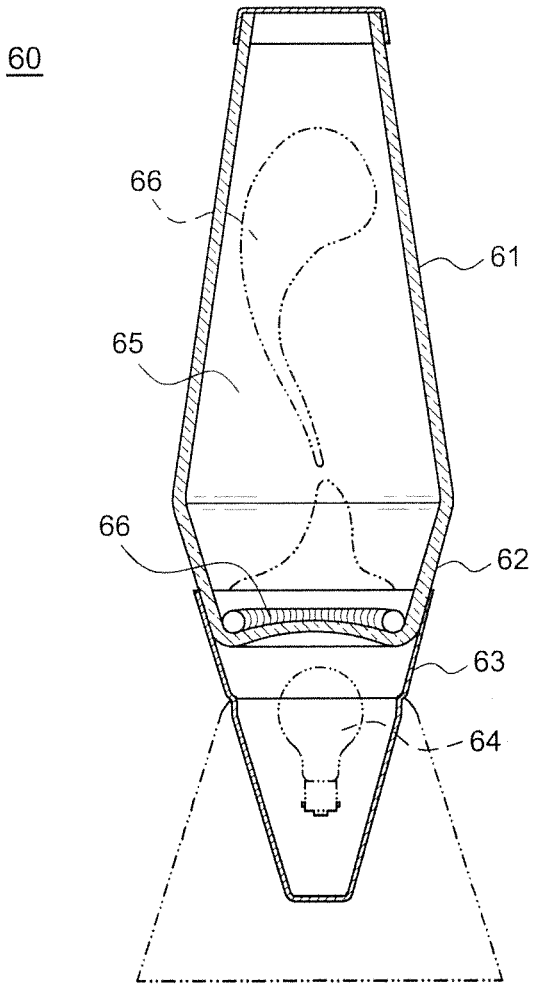
FIG.1 PRIOR ART
FIG. 1 is a schematic view of a conventional lava lamp.
Figure 2:
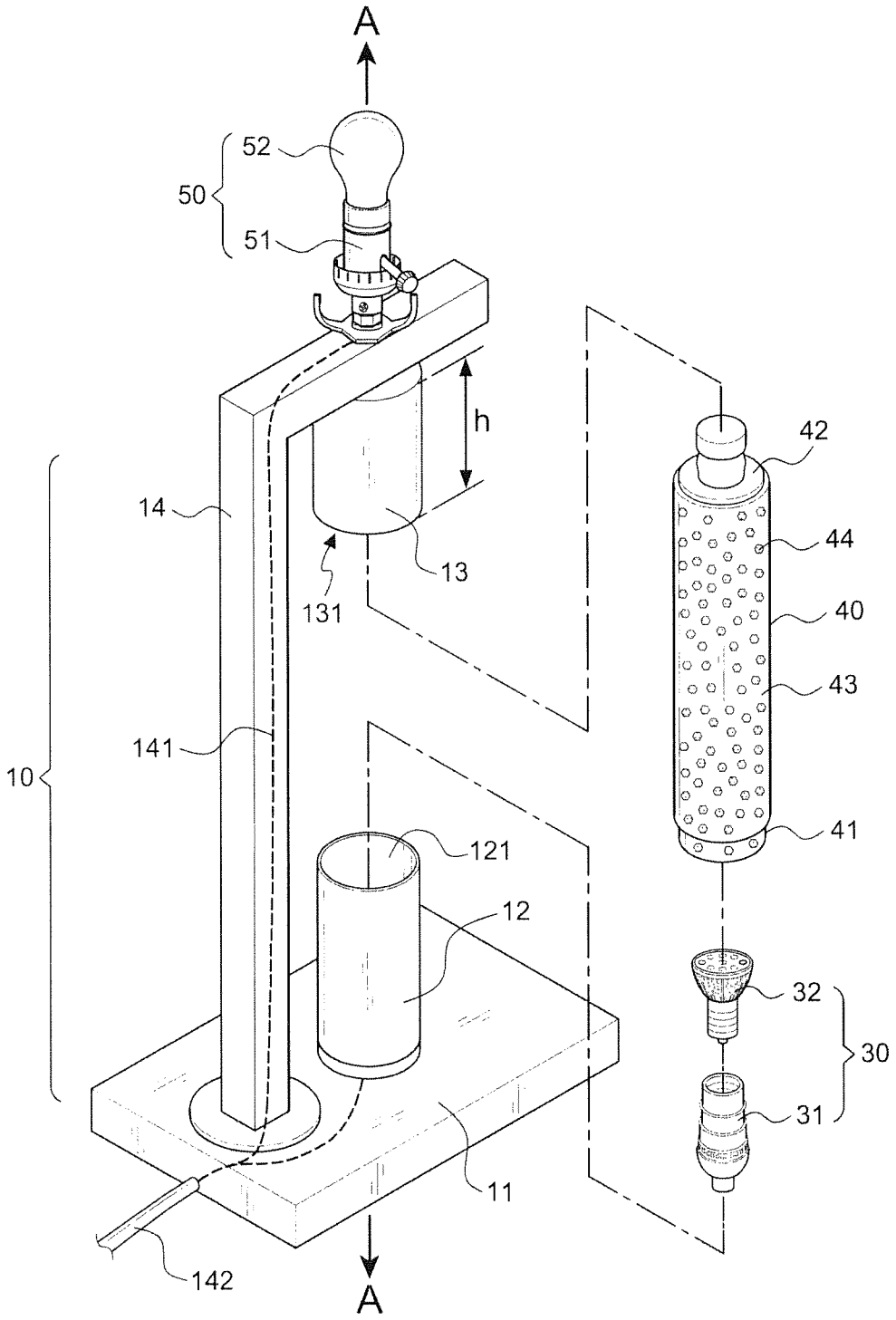
FIG. 2 is an exploded perspective view of a preferred embodiment in accordance with the present invention.
Figure 3:
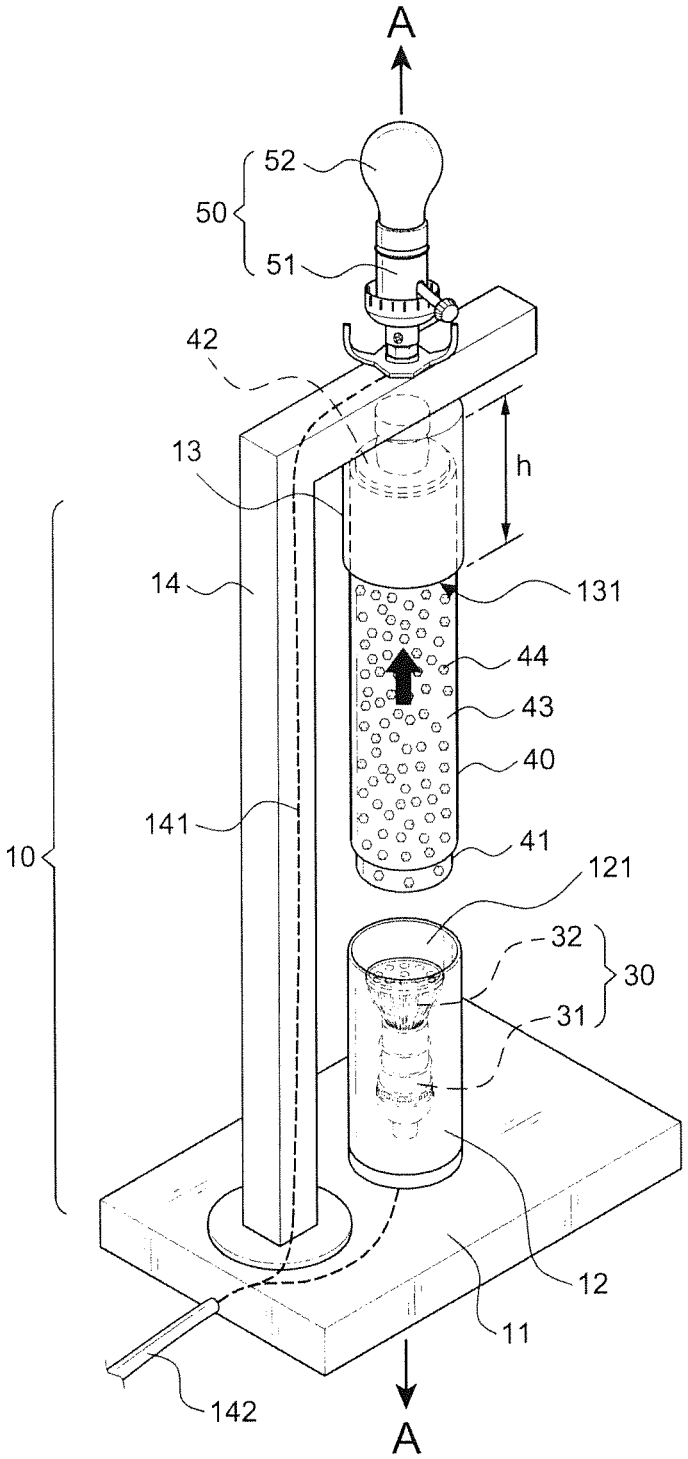
FIG. 3 is a schematic view of a preferred embodiment in accordance with the present invention, illustrating the design of a containing height.

Referring to FIGS. 2 and 3, the preferred embodiment of a liquid motion lamp holder combined lighting in accordance with the present invention comprises: a holder 10 having a base 11 on a bottom thereof for placing on a ground or desktop; a first mounted seat 12 having a bottom mounted on the base 11 and a first containing room 121 with an upward opening at an inner periphery thereof; a second mounted seat 13 arranged on a top of the holder 10 and having a second containing room 131 with a downward opening at an inner periphery thereof and a containing height h of at least 5 cm; a support bracket 14 having an end connecting to a lower end of the holder 10 and another end connecting to the second mounted seat 13 for centers of the first mounted seat 12 and second mounted seat 13 to be vertically located on an axis A-A of the base 11, being in an up-down corresponding state.

With the reference to FIG. 2, a projecting light source 30 as a heat source and illumination includes a first lamp seat 31 mounted at a bottom of the first containing room 121 of the first mounted seat 12 and a bulb 32 mounted on the first lamp seat 31. In the embodiment, the bulb 32 is an LED bulb but it is not a limitation. Moreover, a lighting lamp 50 includes a second lamp seat 51 mounted on a top of the support bracket 14 and a lighting bulb 52 mounted on the second lamp seat 51. The support bracket 14 is hollow for a wire 141 to pass through and connect to the second mounted seat 51 and a power cord 142.

With the reference to FIG. 2, a transparent bottle 40 includes two immiscible substances therein. In the embodiment, the first substance is a solution 43 mixed with calcium nitrate and water and the second substance is a plurality of paillette having similar specific gravity with the solution 43 but it is not a limitation. It is applicable for only if the second substance is suspended in the first substance and it is a prior art and thus will not be described in details here. The transparent bottle 40 as shown in FIG. 3 has an upper end 42 for moving upward to the second containing room 131 to a predetermined height and an inserted section 41 for moving downward to the first containing room 121 so that the transparent bottle 40 is vertically positioned between the second containing room 131 and first containing room 121 and the inserted section 41 has an external diameter slightly smaller than an external diameter of the transparent bottle 40 for quick positioning in the first containing room 121.

Whereby the transparent bottle 40 turns into liquid motion lamp visual effect through a projected light of the LED bulb 32 and required lighting is available through the lighting bulb 52. Due to the design of the containing height h of the second containing room 131, the upper end 42 of the transparent bottle 40 can be vertically moved in the containing height h up and down such that the transparent bottle 40 is easily installed and removed between the first mounted seat 12 and second mounted seat 13.

Figure 4:
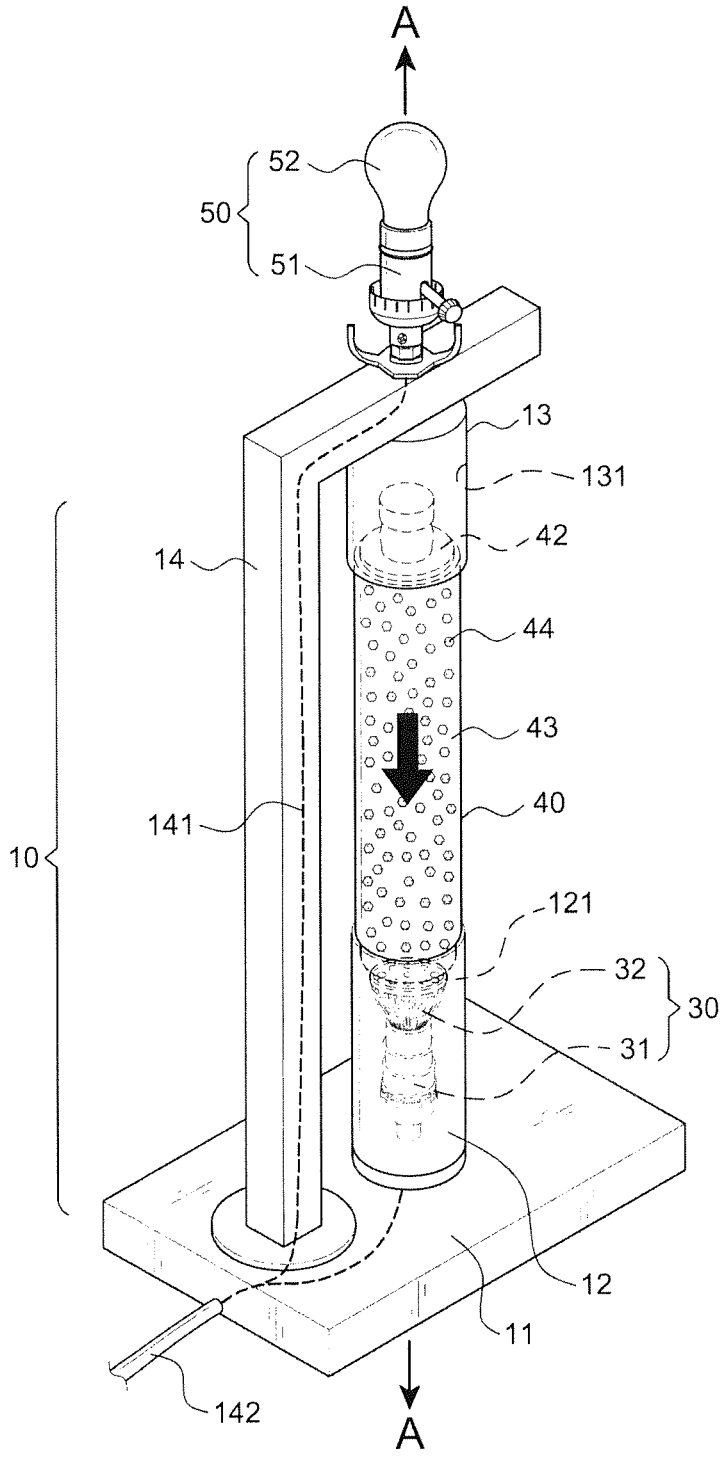
FIG. 4 is a schematic view of a preferred embodiment in accordance with the present invention, illustrating a transparent bottle in an installation state.

With the reference to FIGS. 3 and 4, the upper end 42 of the transparent bottle 40 is first penetrated into the second containing room 131 of the second mounted seat 13 and then the transparent bottle 40 is moved downward until the inserted section 41 of the transparent bottle 40 is inserted into the first containing room 121 of the first mounted seat 12. Due to the upper end 42 of the transparent bottle 40 in the second containing room 131 and the inserted section 41 of the transparent bottle 40 in the first containing room 121, the transparent bottle 40 is securely mounted between the first mounted seat 12 and second mounted seat 13.

Figure 5:
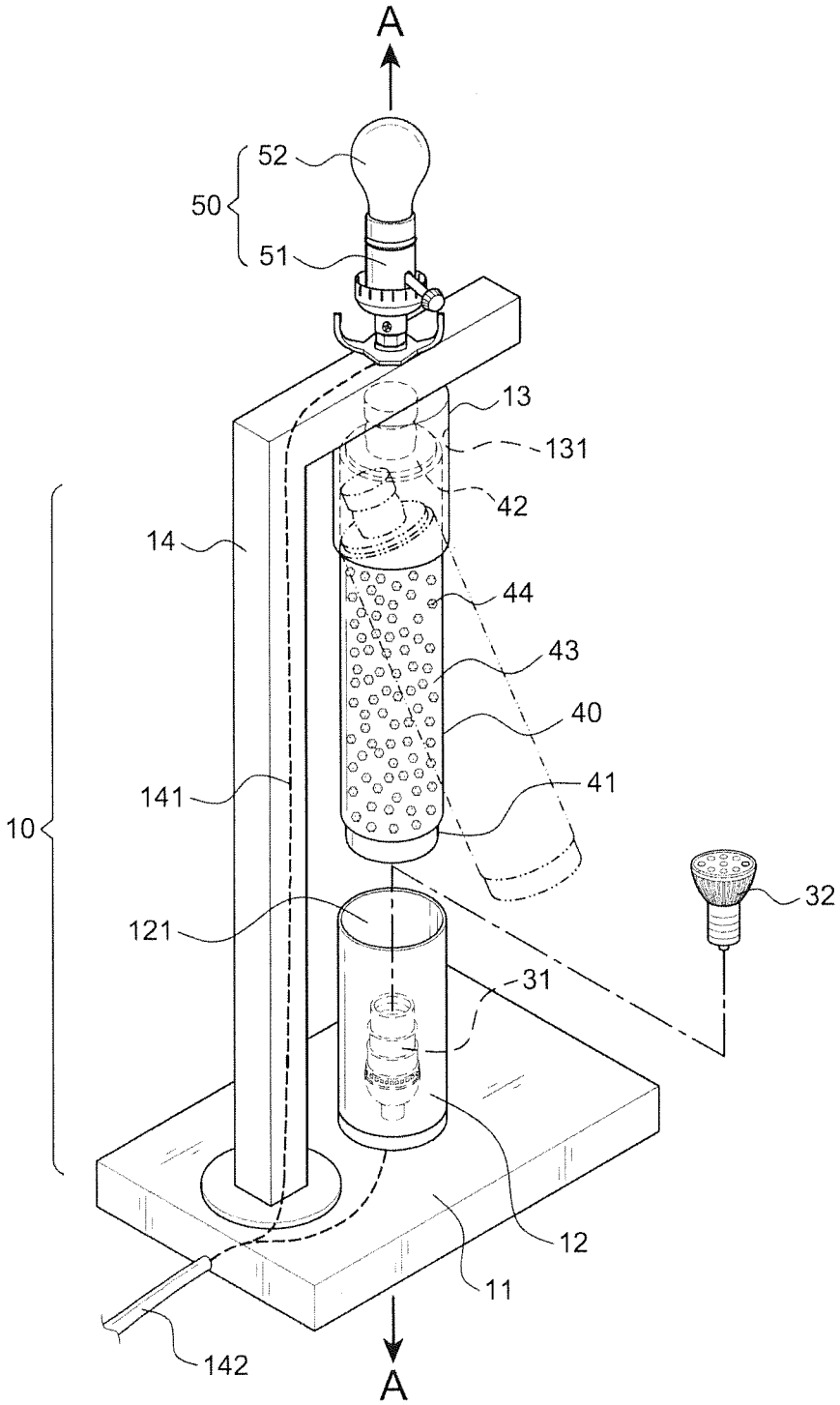
FIG. 5 is a schematic view of a preferred embodiment in accordance with the present invention, illustrating a transparent bottle in a disassembly state.

FIG. 5 illustrates the transparent bottle 40 in a disassembly state. When removing the transparent bottle 40, the first step is to axially move the transparent bottle 40 upward until the upper end 42 of the transparent bottle 40 goes deep to the containing height h of the second containing room 131 and the inserted section 41 of the transparent bottle 40 completely detaches from first containing room 121 of the first mounted seat 12; the second step is to move the transparent bottle 40 downward until the upper end 42 close to the bottom end of the second containing room 131 and then continue downward moving at an angle until the transparent bottle 40 completely detaches from the second mounted seat 13. The user can not only change the transparent bottle 40 but the LED bulb 32 by the above-mentioned steps.

Figure 6:
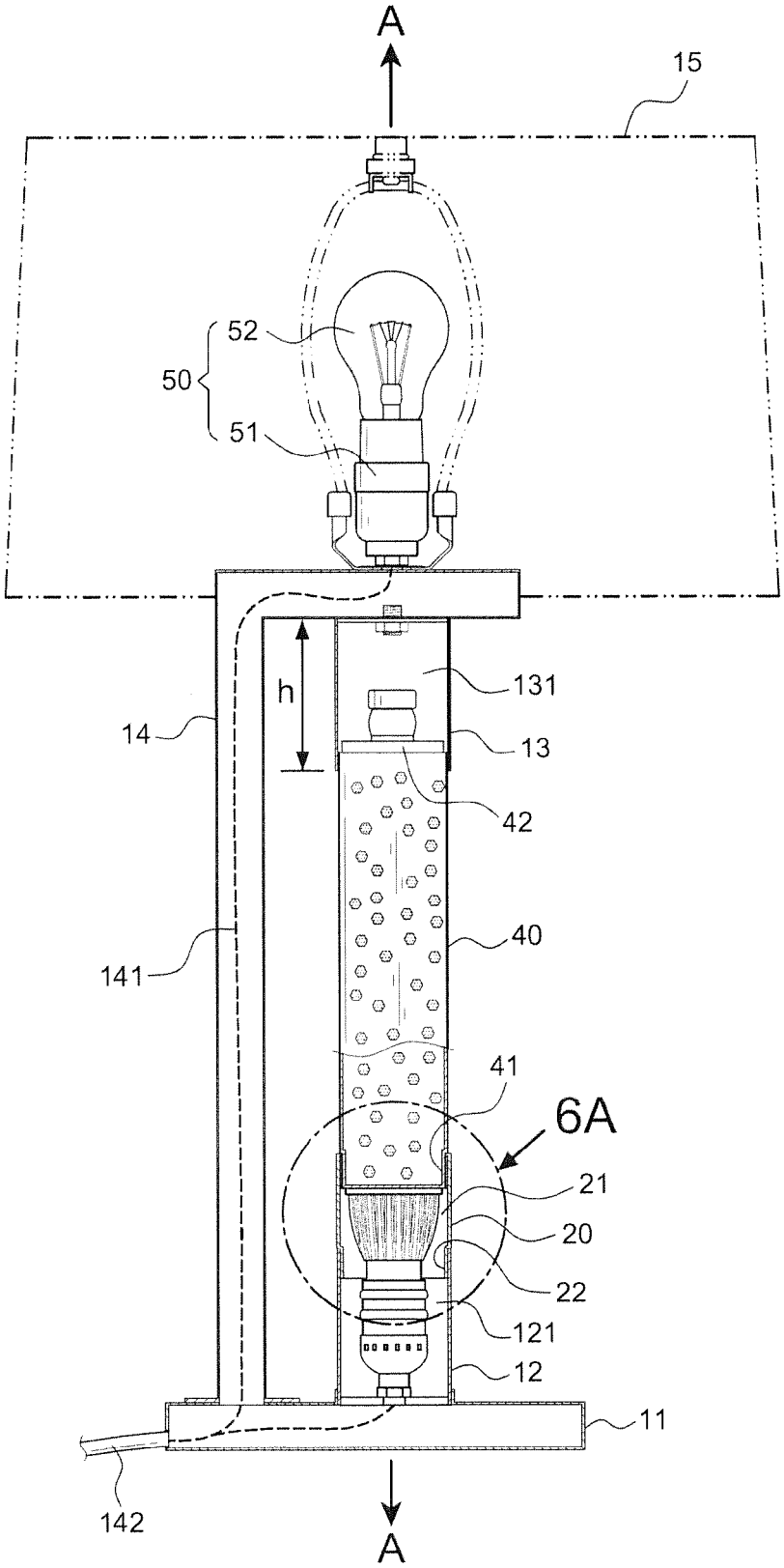
FIG. 6 is a sectional view of the second preferred embodiment in accordance with the present invention, illustrating in an assembly state.
Figure 6A:
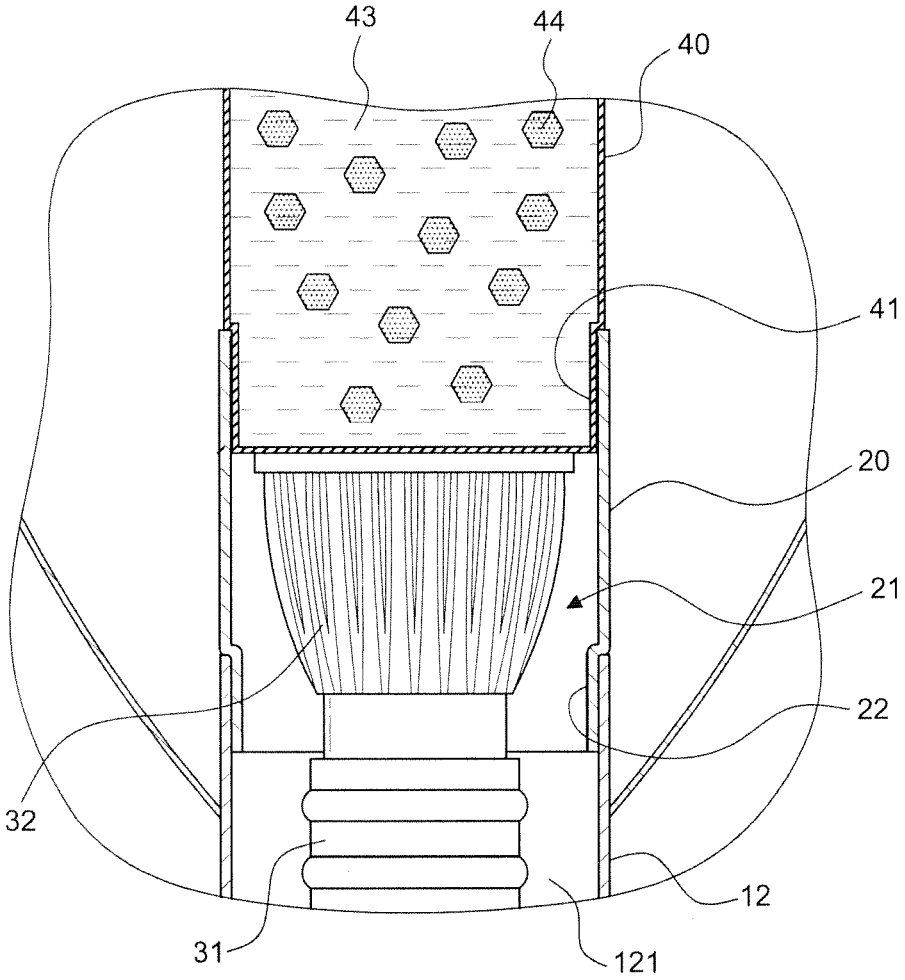
FIG. 6A is an enlarged sectional view of 6A in FIG. 6.

FIGS. 6 and 6A illustrate the second embodiment. The transparent bottle 40 is mounted between the first mounted seat 12 and the second mounted seat 13 by a joint sleeve 20. The joint sleeve 20 has a hollow containing room 21 at an inner periphery thereof and an inserted section 22 at a lower end thereof and an external diameter of the inserted section 22 is lightly smaller than an external diameter of an upper end of the joint sleeve 20. In this embodiment, the inserted section 22 is inserted into the first containing room 121 of the first mounted seat 12 and the inserted section 41 of the transparent bottle 40 is inserted into the joint sleeve 20 of the first mounted seat 12 for securely positioning the transparent bottle 40 on the vertical axis A-A of the base 11. At the same time, the bottom of the transparent bottle 40 is connected to the top of the LED bulb 32 for directly conducting the heat of the LED bulb 32 to the transparent bottle 40. With the reference to FIG. 6, the present invention provides the joint sleeve 20 to reduce the height of the first mounted seat 12 for easily changing the LED bulb 32. Moreover, the dissembled method of the transparent bottle 40 is similar to the description of FIG. 5. The first step is to axially move the transparent bottle 40 as well as the joint sleeve 20 upward until the upper end 42 of the transparent bottle 40 goes deep to the containing height h of the second containing room 131 and the inserted section 41 of the transparent bottle 40 completely detaches from first containing room 121 of the first mounted seat 12: the second step is to remove the joint sleeve 20 from the inserted section 41 of the transparent bottle 40; the third step is to move the transparent bottle 40 downward until the upper end 42 close to the bottom end of the second containing room 131 and then continue downward moving at an angle until the transparent bottle 40 completely detached from the second mounted seat 13. The user can change the transparent bottle 40 but the LED bulb 32 by the above-mentioned steps. In this embodiment, a lampshade 15 is arranged on a top of the support bracket 14 for increasing lighting aesthetic.

Figure 7:
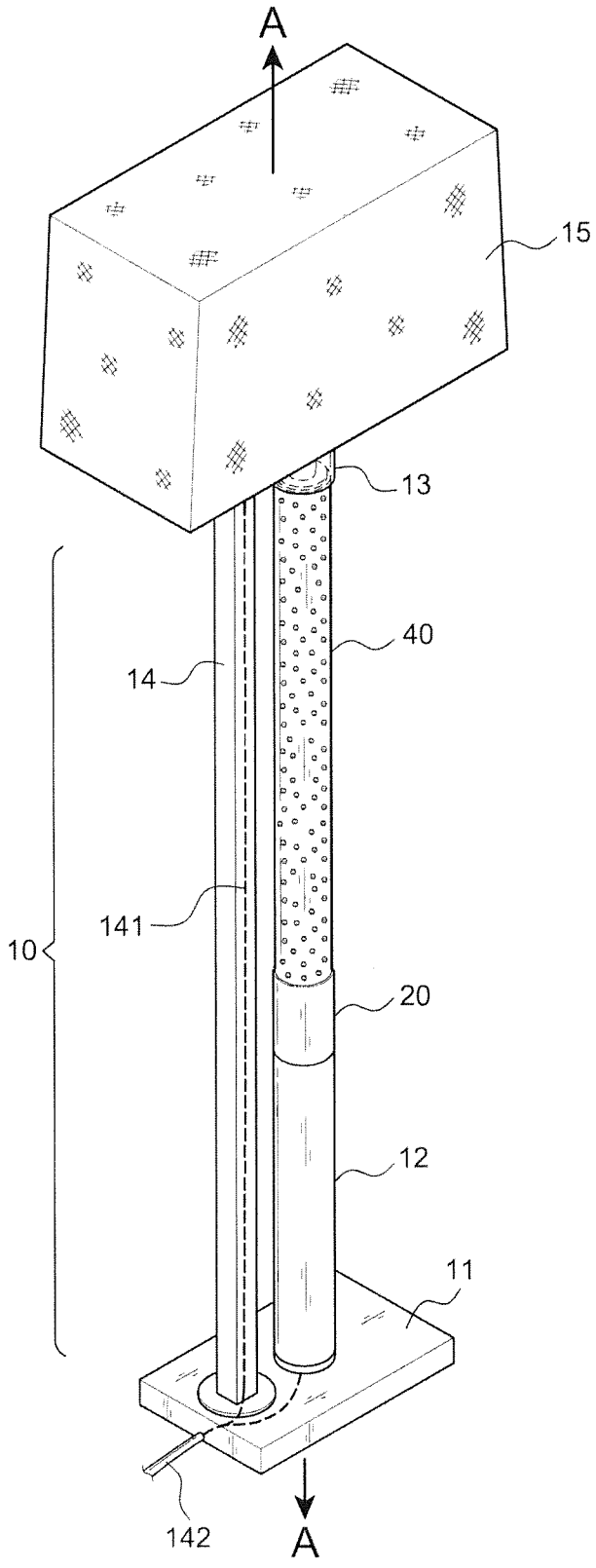
FIG. 7 is a perspective view of the third preferred embodiment in accordance with the present invention, illustrating in an assembly state.

FIG. 7 illustrates the last embodiment of the present invention showing the liquid motion lamp holder applied to a vertical lamp. This embodiment has the same components as the second embodiment. The only difference between the two embodiments is that the length of the first mounted seat 12, transparent bottle 40 and the support bracket 14 in this embodiment is longer than in the second embodiment.

Based on the features disclosed, the present invention provides the liquid motion lamp holder combined lighting to combine lighting and decoration functions-to avoid a transparent container overturning and falling apart which is able to harm human body by flowing-out liquid of the transparent container. The present invention further provides a liquid motion lamp transparent bottle and an LED bulb which are easy to be installed and removed for increasing the convenience and security effects.

What is claimed is:

1. A liquid motion lamp holder combined lighting, particularly to a lamp holder combining a liquid motion lamp and a lighting lamp seat, comprising:

a holder having a base on a bottom thereof; a first mounted seat having a bottom mounted on the base and a first containing room with an upward opening at an inner periphery thereof; a second mounted seat arranged on a top of the holder and having a second containing room with a downward opening at an inner periphery thereof and the second containing room having a containing height of at least 5 cm; a support bracket having an end connecting to a lower end of the holder and another end connecting to the second mounted seat for centers of the first mounted seat and second mounted seat to be vertically located on an axis of the base, being in an up-down corresponding state;

a projecting light source including a first lamp seat mounted in the first containing room of the first mounted seat and a bulb mounted on the first lamp seat;

a lighting lamp including a second lamp seat mounted on the support bracket and a lighting bulb mounted on the second lamp seat; and a transparent bottle arranged between the first mounted seat and second mounted seat and having at least two immiscible substances therein, an upper end for moving upward to the second containing room to a predetermined height and a lower end for moving downward to the first containing room so that the transparent bottle is securely positioned between the second containing room and first containing room;

whereby the transparent bottle turns into liquid motion lamp visual effect through the projecting light source and required lighting is available through the lighting bulb, and the design of the containing height of the second containing room allows an end of the transparent bottle to be moved in the containing height along the vertical axis of the base up and down for the transparent bottle to be easily installed and removed between the first mounted seat and second mounted seat.

2. The liquid motion lamp holder combined lighting as claimed in claim 1, further comprising a joint sleeve mounted between the transparent bottle and the first mounted seat and the joint sleeve has a hollow containing room at an inner periphery thereof and an inserted section having a smaller diameter on a lower end of the joint sleeve for securely inserting into the first containing room of the first mounted seat and the transparent bottle has an inserted section at a lower end thereof for securely inserting into the hollow containing room of the joint sleeve.

3. The liquid motion lamp holder combined lighting as claimed in claim 2, wherein the bulb is an LED bulb.

4. The liquid motion lamp holder combined lighting as claimed in claim 1, wherein the transparent bottle has a bottom in contact with the top of the LED bulb for the heat of the LED bulb directly conducting to the bottom of the transparent bottle.

5. The liquid motion lamp holder combined lighting as claimed in claim 1, wherein the two immiscible substances include a solution mixed with calcium nitrate and water and a plurality of palliate having similar specific gravity with the solution.

6. The liquid motion lamp holder combined lighting as claimed in claim 1, wherein the support bracket is hollow for a wire to pass through and connect to the second mounted seat.

7. The liquid motion lamp holder combined lighting as claimed in claim 1, further comprising a lampshade arranged on a top of the support bracket.

* * * * *